US006843321B2

(12) United States Patent
Carlsen

(10) Patent No.: US 6,843,321 B2
(45) Date of Patent: Jan. 18, 2005

(54) INTERVENTION DEVICE FOR A SUBSEA WELL, AND METHOD AND CABLE FOR USE WITH THE DEVICE

(75) Inventor: Hans-Paul Carlsen, Notodden (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 10/204,606

(22) PCT Filed: Feb. 20, 2001

(86) PCT No.: PCT/NO01/00061

§ 371 (c)(1),
(2), (4) Date: Dec. 16, 2002

(87) PCT Pub. No.: WO01/61145

PCT Pub. Date: Aug. 23, 2001

(65) Prior Publication Data

US 2003/0155127 A1 Aug. 21, 2003

(30) Foreign Application Priority Data

Feb. 21, 2000 (NO) ..... 20000836

(51) Int. Cl.[7] ..... E21B 29/12

(52) U.S. Cl. ..... 166/355; 166/360; 166/77.1; 166/77.3

(58) Field of Search ..... 166/355, 343, 166/360, 352, 350, 378, 77.1, 77.3

(56) References Cited

U.S. PATENT DOCUMENTS

| | | | | | |
|---|---|---|---|---|---|
| 3,568,767 | A | * | 3/1971 | Weiss | 166/351 |
| 3,602,300 | A | * | 8/1971 | Jaffe | 166/351 |
| 3,638,722 | A | | 2/1972 | Talley, Jr. | |
| 4,577,693 | A | * | 3/1986 | Graser | 166/338 |
| 4,825,953 | A | | 5/1989 | Wong et al. | |
| 4,899,823 | A | | 2/1990 | Cobb et al. | |
| 4,993,492 | A | | 2/1991 | Cressey et al. | |
| 5,088,558 | A | * | 2/1992 | Mohn | 166/339 |
| 5,553,668 | A | * | 9/1996 | Council et al. | 166/77.3 |
| 5,671,811 | A | | 9/1997 | Head | |
| 6,042,303 | A | * | 3/2000 | Head | 405/195.1 |
| 6,102,125 | A | * | 8/2000 | Calder | 166/359 |
| 6,116,345 | A | * | 9/2000 | Fontana et al. | 166/343 |
| 6,386,290 | B1 | * | 5/2002 | Headworth | 166/346 |
| 6,591,913 | B2 | * | 7/2003 | Reaux et al. | 166/352 |
| 6,648,081 | B2 | * | 11/2003 | Fincher et al. | 175/25 |

FOREIGN PATENT DOCUMENTS

| | | | |
|---|---|---|---|
| GB | 2 334 049 | A | 8/1999 |
| WO | WO 97/40255 | | 10/1997 |
| WO | 01/25593 | * | 12/2001 |

* cited by examiner

*Primary Examiner*—Thomas B. Will
*Assistant Examiner*—Thomas A Beach
(74) *Attorney, Agent, or Firm*—Christie, Parker and Hale, LLP

(57) ABSTRACT

A device for intervention of a subsea oil and/or gas well by means of a tool (8) suspended by a cable (9), fed from or withdrawn to a vessel (1) and driven by a drive mechanism (12) located on the vessel. The device comprises a lubricator (5) having a tool housing for the insertion of the tool into the well, and a stuffing box (40) sealing around the cable after the tool is inserted into the well. According to the invention an injector which drives the cable in the well is located on the lubricator, and is controllable independently of the drive mechanism for the cable located on the vessel. The drive mechanism and the injector may be synchronized in a manner, among others, providing that the cable is hanging in a predetermined arc during the intervention, whereby the vessel may be moved from the well. Moreover, the invention relates to a method and a cable used together with the device.

28 Claims, 6 Drawing Sheets

357
374
365
369
354
375
358
350
365''
365'
367
363
359a
359a'
365
9
359b
360a
360b
366
368
361
359a
374
9
362
375
360a

INTERVENTION DEVICE FOR A SUBSEA WELL, AND METHOD AND CABLE FOR USE WITH THE DEVICE

CROSS-REFERENCE TO RELATED APPLICATION

This application claims priority of International application number PCT/NO01/00061, filed Feb. 20, 2001, which in turn claims priority of Norwegian application number 20000836, filed Feb. 21, 2000.

FIELD OF THE INVENTION

The invention relates to a device for intervention of a subsea well by means of a tool or the like suspended by a cable, fed from, respectively withdrawn to a vessel or the like, and driven by a drive mechanism located on the vessel, said device comprising a lubricator adapted to be located at a subsea Christmas tree in the well, and having a tool housing, for the insertion of the tool into the well, and sealing means, which encloses the cable in a slidable and sealed manner after the tool is inserted into the well.

Moreover, the invention relates to a method and a cable for use together with the device.

BACKGROUND OF THE INVENTION

Works are performed in an oil or gas well to stimulate or treat the well, whereby the production is increased, to replace various equipment such as valves, to make measurements, to monitor the state of the well, or anything else being required.

Treatment of the well to increase the production rate or volume is made after a cost/benefit evaluation. Even if the production from a well may be increased by several factors, the intervention costs may become too high or the work considered too difficult and time consuming. For onshore or platform wells, having easy access into the Christmas tree and infrastructure in the form of lifting equipment etc., the costs of performing the well intervention will be less relatively to the benefit of the operations. An intervention of subsea wells is much more expensive. A vessel (drilling rig or the like) has to be used, involving large daily expenses and, in addition, time consuming transit to and from the field, and large costs as the work is much more time consuming. Because of this, the production volume from a platform or onshore well is up to twice the volume of a subsea well with similar reservoir conditions. As mentioned above, this is caused by the more easy access making a better programme for well maintenance practically possible and profitable.

A well intervention may be difficult, as existing barriers have to be removed before entering the well. There are strict rules regarding which measures being required to prevent an uncontrolled blowout during such works. Thus, when well intervention shall be performed, a provisional pressure barrier has be established in the form of a blowout preventer. Depending on the work to be performed, this may vary from simple stop valves to large drilling BOPs.

PRIOR ART

In accordance with standard practice the vessel is positioned vertically above the well, i.e. mainly in an extension of the well axis. If an uncontrolled blowout should occur, the vessel may lose buoyancy due to the gas flowing to the surface from the well, resulting in loss of human lives. Another disadvantage of this position involves that the vessel must be provided with heave compensator means to balance wave motions during the operation.

By performing works (intervention) in a well many types of equipment are used: a coiled tubing, wire or possibly just a string (so-called "slick line"). The various types of intervention equipment for wells have to be selected depending on the complexity of the works to be done. As mentioned above, all of the intervention types have in common that the well is "opened" against the surroundings. Therefore, to avoid discharge of hydrocarbons, the tools have to be inserted in a sealed but, simultaneously, slidable manner into the well, whereby the tool may be lowered in the well.

Coiled tubings are used during larger works and, in particular, when there is a need of performing circulation, as during stimulation of the well (chemical treatment or fracturing). The disadvantage is that this intervention type is very expensive as the use of a drilling rig is required.

Wires are used when there is no need of circulation, e.g. during measurements. Wires may also be provided with conductors for power supply and signal transmission. Often, wires are used for the intervention due to their large rupture strength and, thereby, may be used when the tool is relatively heavy.

Because of the spaces between the wire components, the disadvantage of the wire is that a particular injector for grease (so-called "grease injector head") must be used, by which grease under pressure is continuously injected to seal around the wire. Thereby, the tool may be lowered in the well without discharge of oil and gas from the well while securing a pressure-proof barriere. Even if the grease provides relatively low friction and enables lowering of the tool by its own weigth, this method requires large investments for equipments and materials, in particular grease. Therefore, large quantities of grease are consumed during this procedure. The used grease may not be directly discharged into the sea due to the risk of pollution and, therefore, it will normally be led to the vessel for a cleaning and possible recovery. As a result, the vessel has to be relatively large (and thereby expensive) due to all of the equipment located on the vessel.

A lubricator of the type discussed above is known from U.S. Pat. No. 3,638,722.

In some cases, when the tool to be lowered is not too heavy, for example during sample collecting, a string may be used. By the use of such a thin string, the grease injector head mentioned above may be replaced by more simple sealing means, for example a so-called stuffing box. The stuffing box comprises a tubular sleeve of rubber or the like. The cable is tightly enclosed by the tubular sleeve in an extent preventing discharges but simultaneously without making the friction between the string and the sleeve too large. This is an inexpensive method of well intervention.

However, a disadvantage of the previous stuffing box types is that the providing of such a sealing around the string may result in a too large friction. Another disadvantage is that such strings have a limited strength, and also a limited usability as power supply or signal transmission means are not included.

As both wires and strings are flexible, these are only appropriate in vertical wells, and when the weight of the tool is sufficiently to draw the wire or string through the stuffing box. On the contrary, in horizontal wells the tool must be provided with a tractor for the drawing of the tool and wire, or the string.

SUMMARY OF THE INVENTION

An object of the invention is to be able to perform the intervention in a manner enabling that the tool cable may both be driven to move the tool in the well and in response to the movements of the vessel at the surface.

Another object of the invention is to be able to perform the intervention having the vessel in offset surface positions in relation to the vertical axis of the well.

A further object of the invention is to be able to perform the intervention from a smaller and, thus, more inexpensive vessel.

Still another object is to be able to perform the intervention by means of a cable combining advantages of both wires, i.e. a high rupture strength and possible use of copper lines, and strings, i.e. the possibility to use much more simple sealing means, such as a stuffing box.

According to one aspect of the invention, the present device comprises an injector located on the lubricator, by which the cable is driven in the well, and as the drive mechanism located on the vessel and the injector located on the lubricator are independently controllable, the cable may both be driven to move the tool in the well and in response to the movements of the vessel at the surface.

According to another aspect of the invention the injector, driving the cable in the well, is replaced by a self-movable tractor fastened to the cable or tool.

According to a further aspect, the invention relates to a method of use together with the present device, wherein the cable is driven in response to the movements of the vessel by the drive mechanism located on the vessel, and downwards in the well by the injector located on the lubricator, respectively the self-movable tractor fastened to the cable or tool, whereby the movement of the vessel is permitted from a position in extension of the well axis, and wherein the drive mechanism is controlled in a manner maintaining the cable in a slacked arc in the sea.

According to a further aspect the invention relates to a cable for use together with the present device and/or method, which comprises a plastic material reinforced by carbon or glass fibre, whereby the cable achieves the desired degree of rigidity, and a coating of a material having low friction coefficient.

Thus, potential dangerous situations during, for example, a gas blowout may be avoided, as the vessel can be situated aside the well. On the contrary, if the vessel is situated straigthly above the well, a gas blowout might involve that the vessel loses buoyancy and sinks, causing loss of human lives.

Another important advantage of the invention is that the vessel, to some extent, may be drifted by the weather and wind and, thereby, be adjusted to the varying conditions at the surface. The vessel may drift as far away as permitted by the length of the cable and/or umbilical.

Another great advantage of the invention is that different lengths of the cable and umbilical may be present in the sea. For example, during a situation in which the cable has to be cut, it will normally be sufficient of time to close all of the valves, detach the umbilical from the seabed in a controlled manner and withdraw this to the vessel. Vice versa, if the umbilical has a defect or has to be cut (involving that all of the valves in the lubricator and well have to be closed), it will normally be sufficient of time to withdraw the cable slack before this is cut.

The cable may readily be fished out by means of a ROV, and the work continued when the dangerous situation has been remedied.

One particular advantage of the invention is that a light vessel may be used. When the injector is used together with the preferred lubricator, the unwanted fluids may be circulated in the well, as discussed in NO Patent No. 309439. This might result in great savings, as there is no need of large and heavy equipment for the treatment of the hydrocarbons on the vessel.

Moreover, the cable may be provided with friction at the same level as a string and, therefore, the use of a more simple type of sealing means is enabled.

Other aspects and advantages of the present invention will be understood from the dependent patent claims and embodiments of the present invention described hereinafter.

BRIEF DESCRIPTION OF THE DRAWINGS

The invention shall hereinafter be described by referring to the accompanying drawings.

DESCRIPTION OF EMBODIMENTS

Figure 1:
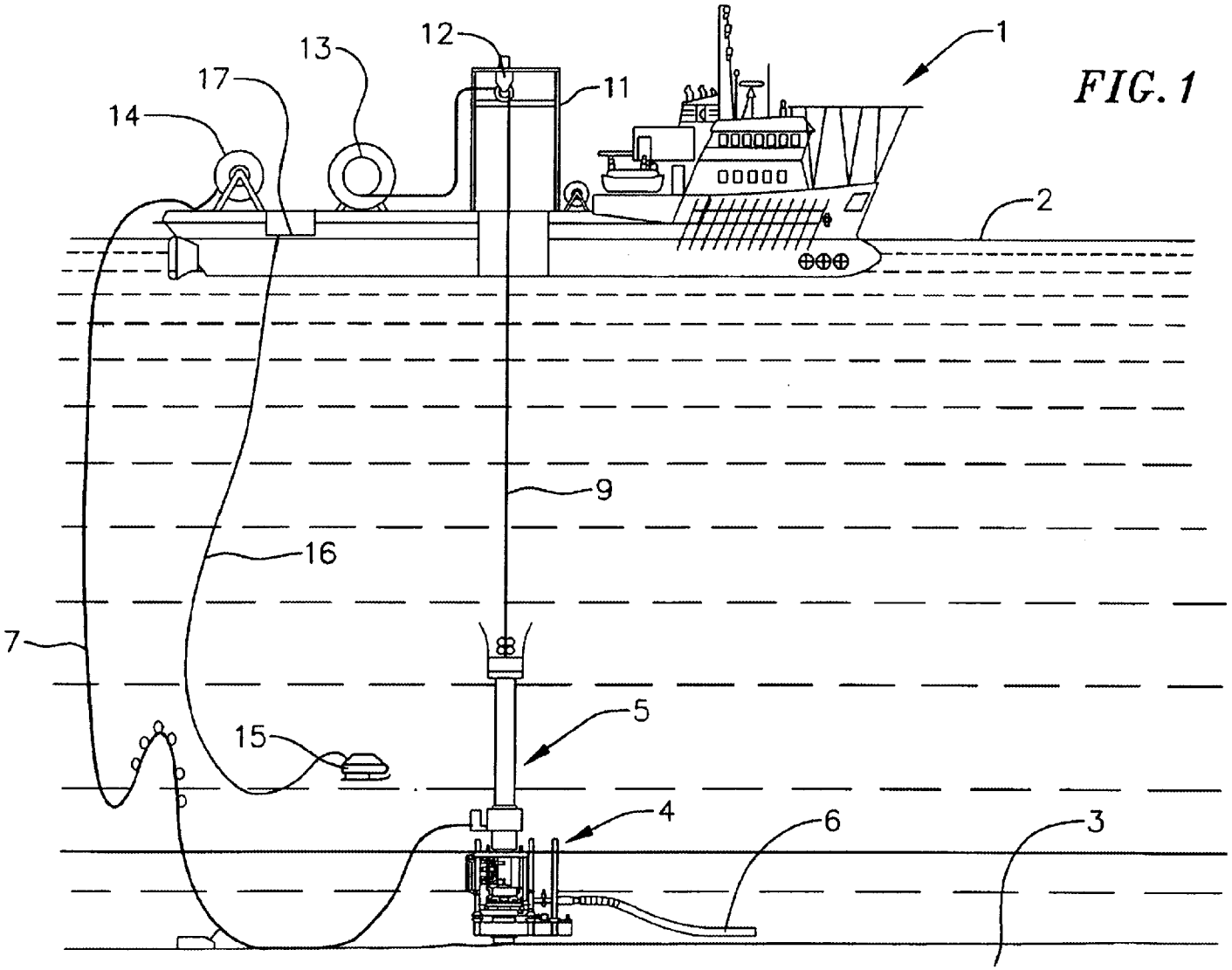
FIG. 1 is an illustration showing a first aspect of the invention.

In FIG. 1 is shown a vessel 1 floating on a mass of water 2. The vessel has various equipment for controll, measurements, etc. well known in the field. In particular, the vessel is provided with heave compensator means and dynamic positioning (DP) means to keep the vessel in a correct position.

A Christmas tree 4 for a well 10 is situated at the seabed 3, which Christman tree is completed and made ready for production in accordance with standard practice. Produced oil and/or gas flowing upwards from the well is led through a pipeline 6 to a production facility, such as a production vessel.

The vessel includes a tower 11 comprising a drive mechanism 12 for cable 9. The drive mechanism may be a motor-driven drum, which may unwind or wind the cable, although an injector located on the tower 11 is preferred, as indicated in FIG. 1.

Moreover, storing means 13 for a tool cable 9, and a storing drum 14 and storing drum 17 for an umbilical 16 and umbilical 7 for a subsea robot (ROV) 15, respectively, are located on the vessel.

A lubricator assembly 5 is mounted at the top of the Christmas tree 4 in the well, providing controlled access into the well. Generally, such a lubricator comprises a pressure controll assembly including valves to controll the well during the intervention procedure, a tool housing assembly comprising an insertion column for a tool or the like to be inserted into the well, and means for slidable but sealed leadthrough of the wire or string suspending the tool, i.e. a grease injector head or stuffing box. The components are removably connected to one another using connector means. The lubricator may be of a prior art type, for example as disclosed in U.S. Pat. No. 3,638,722, but is preferably of the type described in the applicants own NO Patent No. 309439, and it is referred to the latter for a further description of the lubricator.

Figure 4:
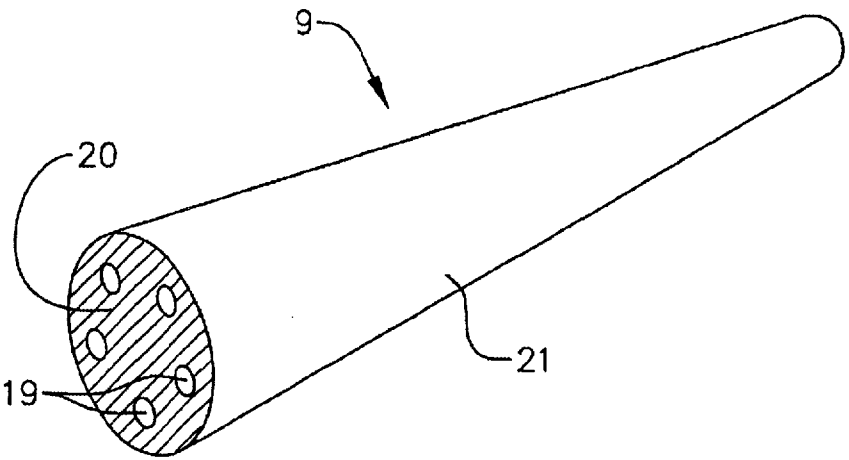
FIG. 4 is an illustration of the preferred cable type.

According to the present invention, a cable having specific properties in respect of the surface and the tensile and bending strength is developed for use together with the present intervention device. FIG. 4 shows an embodiment of such a cable. Preferably, the cable is manufactured of a fibre reinforced composite material, preferably glass or carbon fibre, in a vinyl ester matrix or, alternatively, of other plastics materials providing the required physical properties.

An appropriate cable must have a low density in the range of 1–2 g/cm$^3$ but, preferably, not more than 1,5 g/cm$^3$. This provides a cable having approximately neutral buoyancy in oil (i.e. in the well). The low density also results in more easy storing and transport of long cables because of a lower total weight. Moreover, the forces required to withdraw the cable (with the tool) from the well are reduced by the lower weight.

The cable must have low thermal conductivity in the range of 0,25–0,35 W/mK, and low thermal expansion coefficient in the range of 0,00013 per ° C.

The rupture strength of the cable is about 46 kN, i.e in the same range as steel wires having the same external diameter, tensile strength in the range of 850–1600 MPa, and an elastic modulus in the range of 40000 (glass fibre) –135000 (carbon fibre) MPa. This flexibility provides a cable both being relatively rigid and windable on a drum for transport to and from the field (i.e. as a coiled tubing). Due to the rigidity of the cable, it may be pushed into the well having a low angle, or into a horizontal well (as a coiled tubing), which is impossible for wires or strings.

The cable surface should have a friction coefficient of less than 0,2, preferably down to 0,1. For example, this is achieved by means of a cable coated by an external layer of a material having low friction coefficient.

FIG. 4 shows an illustration of a cable 9, which shall be used together with the device according to the invention. It comprises a mass 20 having one or more encased metal threads or lines 19. The lines are used for control of the tool and signal transmission from it, and, preferably, they are protected by a jacket. The cable is coated by a material providing a external surface 21 with a low friction coefficient.

Figure 5:
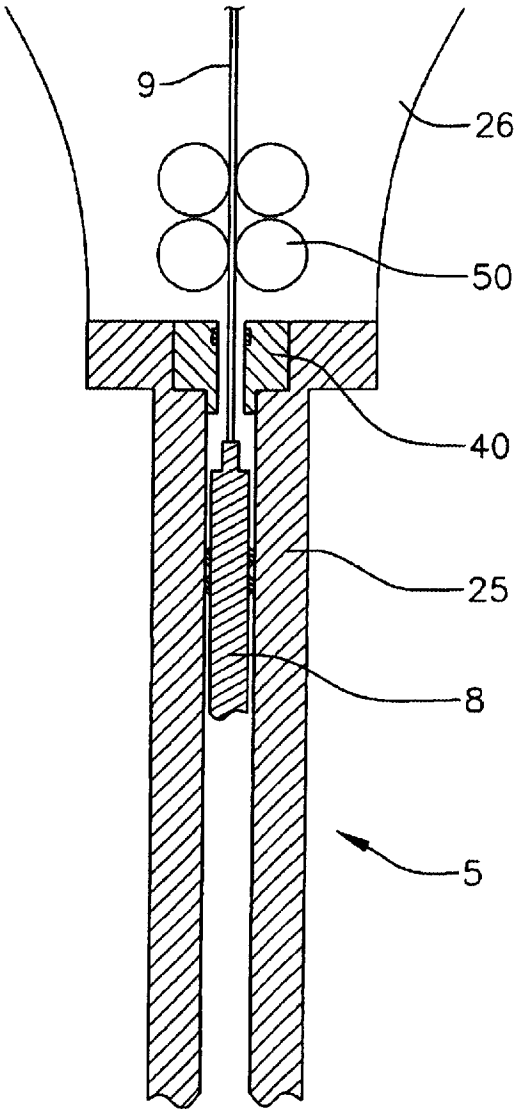
FIG. 5 is an illustration showing the upper part of a subsea lubricator, and the situation when a tool is located in the tool housing of the lubricator.

FIG. 5 is an illustration of an upper part of a lubricator 5 mounted at the top of the well. The tool 8 suspended by the cable 9 is inserted into the well via a tool housing 25 in the lubricator, and a sealing assembly 40 seals around the cable. The sealing means shall be described hereinafter. A feed and drive mechanism 50 is located above the sealing means, and is intended to push the cable 9 into or withdraw it from the well, as also will be described further hereinafter. Means (not shown) securing the sealing means 40 during the use are located in the lubricator, which may include a funnel 26 to facilitate the insertion of the tool into the tool housing.

The feed mechanism 50 comprises connecting means (not shown) for the connection at the top of the tool housing 25. As shown in FIG. 5, the sealing means 40 are arranged in a spacing within the feed mechanism but might be situated in any desired position, for example within the tool housing, possibly also as a separate assembly connected between the feed mechanism and the tool housing.

Figures 6A, 6B, 6C:
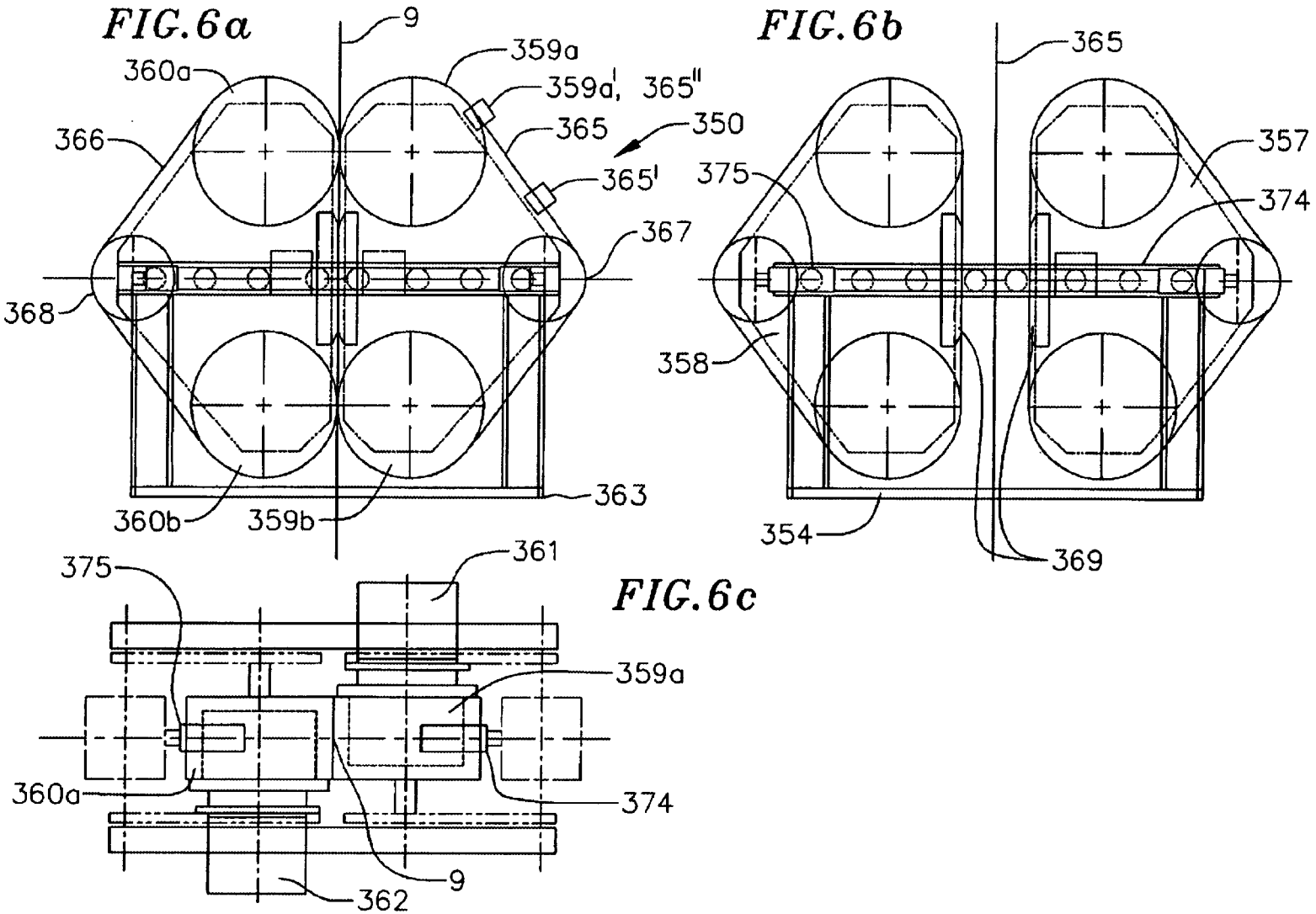
FIGS. 6*a–c* is a vertical sectional view of an injector according to the invention.

In a preferred embodiment of the present device, an endless belt or the like may be driven by one or more motors, as shown in FIGS. 6*a–c*. The injector 350 comprises two main parts movably arranged in relation to a supporting beam 354. The two parts may be moved linearly towards and from the center line 90 by means of hydraulic actuators 374, 375.

The two main parts are symmetrical. Upper 359*a* and lower 359*b* drive rollers are arranged in one of the main parts, and are rotated by one common or its own motor 361. In addition a further free roller is arranged. A belt 365 runs above the rollers. The roller 367 may be provided with means to tighten the belt, for example the hydralic actuator 374, pressing the roller 367 from the center line 90, i.e. to the right in FIG. 6*a*. A counter plate 369 is located between the rollers 359*a, b*, and keeps the belts pressed against the cable in the area between the rollers 359, *a, b*.

The other of the main parts 358 is identical to the first one of the main parts 357 but inverted in relation to this. Thus, it includes corresponding drive rollers 360*a*, 360*b*, 368 for a belt 366.

Preferably, the inside of the belts is formed with teeth for engagement with corresponding teeth on the drive rollers as depicted schematically at 359*a*' and 365' but may also have, for example, a frictional coating. The outside of the belts is preferably coated with a frictional coating of an appropriate material and is provided with a suitable groove as depicted schematically at 365' for the cable.

When the two main parts are moved towards one another, the cable will be clamped between the belts. The starting of the motor will move the belts and, thereby, the cable will be moved out from and into the well.

The main parts 357, 359 must be able to be moved radially out from the center, whereby the stuffing box might be led through the injector.

Preferably, the motors are hydralically driven motors, as such are favourable for use in sea water, and a hydraulic medium is available via the umbilical. Possibly, these might be driven by sea water from a pump located in connection to the lubricator. An advantage of having hydraulic motors is that these might readily be coordinated to provide the same rotating velocity and torque. However, the motors might be of any desired type, for example electrical motors.

The injector shown in FIGS. 6*a–c* only is one of many alternatives appropriate for such an injector. For example, it is possible to use an injector comprising at least one pair of drive rollers located on each side of the cable and intended to be in direct contact with this, and which can be moved from and towards the center line during the insertion of the tool into the well. Otherwise, the skilled person will understand that the indicated injector may comprise another number of motors and drive rollers, and these may be located in another manner than shown, as well as more pairs of the drive belts.

During the intervention of a well by means of a cable of the type above, sealing means have to be provided, which are able to seal against the cable, avoiding discharge of hydrocarbons while keeping the friction between sealing/cable as low as possible, whereby the cable may slide through the sealing means.

Figure 7:
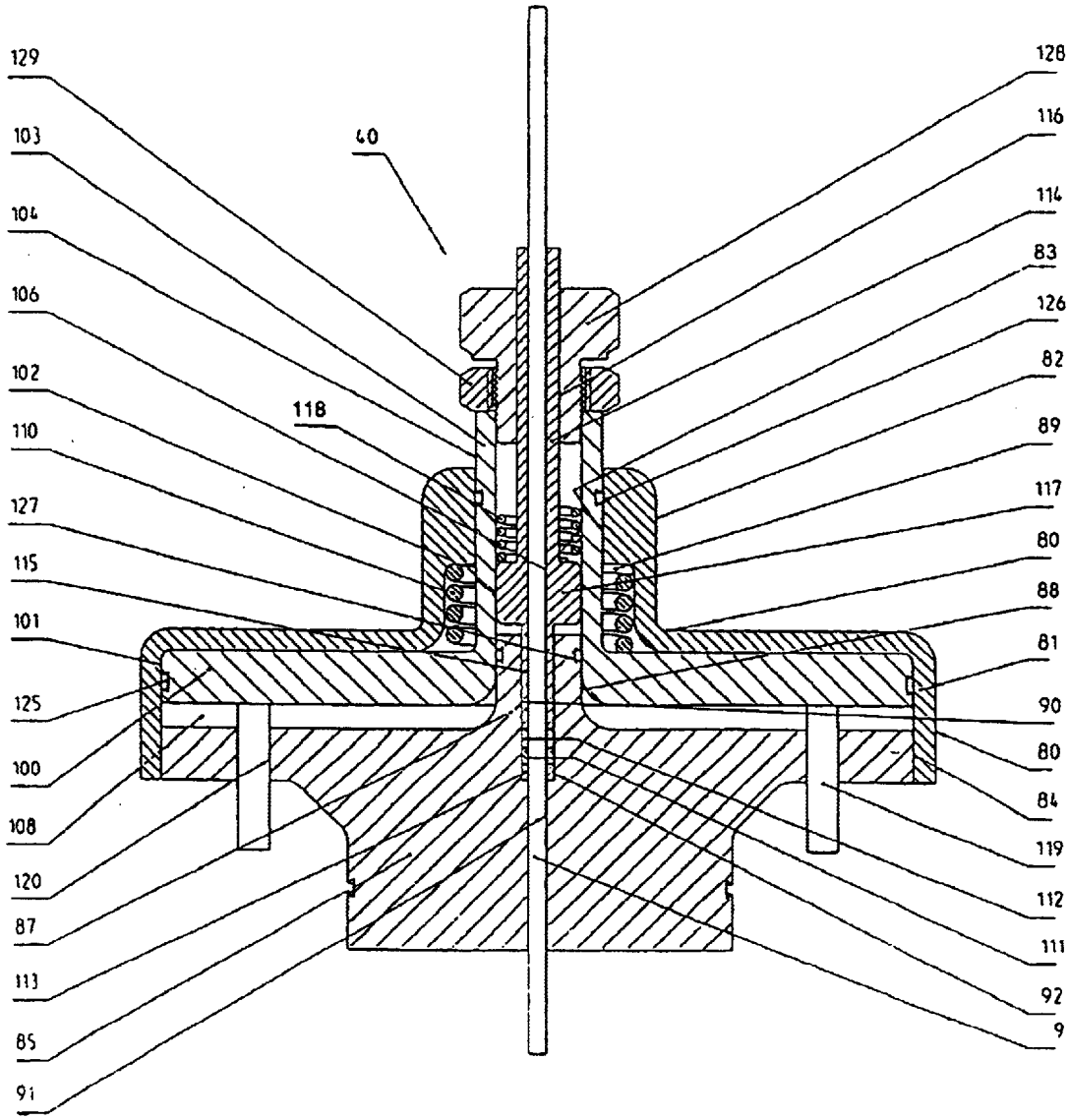
FIG. 7 is a vertical sectional view of the sealing means, which seals around the cable after the tool is inserted into the well through the tool housing of the lubricator.

FIG. 7 shows an example of sealing means for use together with the device according to the invention, which is denoted a stuffing box hereinafter. The stuffing box 40 comprises an external housing 80. As shown in FIG. 7, the housing is of cylindrical shape but may be of polygonal shape, for example square. The housing 80 has a first lower portion 81 opening downwards to provide a hollow cylinder having a first internal diameter 84. The housing has a second upper portion 82, which in the same manner has the shape of a hollow cylinder The portion 82 defines a first cavity 89, which is used as a spring chamber, and a second cavity having a second smaller internal diameter 83. The portion opens upwards.

An end piece 85 is arranged at the end of the first portion, and defines a piston chamber together with the housing 80. The end piece 85 is fastened to the portion 81, for example by screws 86.

The end piece 85 has a portion 87 providing a stub 87 facing upwards, and having an external diameter 88. A center bore 90 extends through the end piece. The bore has a first lower portion having an internal diameter 91, which enables the cable to pass with a small clearance, and a second upper portion having an internal diameter 92, which is larger than the first diameter and intended to receive a stuffing box sleeve.

A piston 100 is movably arranged in the housing 80. In FIG. 8 the piston is shown as an annulus piston, and it has an external circumferential surface 101 intended for slidable engagement against the internal surface 84 of the skirt 81. The piston is extended upwards by a stub 103 having an external diameter 104 intended for slidable engagement against the surface 83. The piston with the stub is annular of shape, whereby a central axial cavity having an internal diameter 102 is defined, which is intended for slidable engagement against the stub 87. Thus, the piston may slide upwards and downwards within the housing 80.

As the use of complex hydraulic actuators within the stuffing box should be avoided, transmission pins 119 moving the piston 100 are arranged in the preferred embodiment. In FIG. 8 only two such pins are indicated but, of course, a number of pins may be equally distributed around the circumference. Thereby, the actuators moving the pins may be located outside the stuffing box.

Alternatively, the piston may be actuated by supplying hydraulic fluid into the piston chamber 108, whereby the piston may be moved upwards into the upper position in the housing 80. If so, sealings, i.e. O-rings 125, 126, 127, must be located between the piston 100, housing 80 and end piece 85. In such a case means, i.e. connectors, have also to be provided for the supply of hydralic fluid, increasing the complexity.

A sleeve 111 of an elastic material is removably arranged in a portion 92 of the bore 90. The sleeve is formed as a sealing sleeve intended to be pulled on the cable with a small clearance. For this purpose, the sleeve 111 has a hole 113 therethrough, in which the cable shall slide. In a preferred embodiment the sleeve is manufactured of one piece, which is pulled on the cable before the use. However, it may consist of two semi-cylindrical parts having grooves in the planar surface, whereby it encloses the cable when the two halves are joined. The sleeve has an external diameter 112 slightly smaller than the internal diameter 112 of the portion 92.

Appropriately, the sleeve is manufactured of an elastomer, such as rubber, for example of hydrogenated nitrile rubber. Other materials may be thermoplastics, for example polyurethane or PTFE (TEFLON). The latter has particularly low frictional properties.

A further sleeve 114 is located in the housing, and serves as a compression sleeve. The compression sleeve 114 has an internal bore therethrough having a larger diameter than the external diameter of the cable 9, whereby the cable may slide through the sleeve without hindrance. The compression sleeve 114 comprises a first portion 115 having an external diameter, whereby it may slide with a small clearance in the bore 91 of the bottom piece 85, and a second upper portion 116 having an external diameter slightly larger than the first portion. The sleeve has a flange 117 between these two portions having an external diameter which enables the flange to slide in a sealed manner within the stub 103 of the piston 100.

A nut 128 is screwed inside the stub 103. A lock nut 129 is screwed on the nut 128 in order to lock this A first spring 110 is located in the spring chamber 89, and is intended to force the piston into its lower position. Around the upper part of the compression sleeve a second spring 118 is located. This spring rests on the flange 117, and it is affected by the nut 128.

The spring 118 transmits its force to the flange 117 and, thereby, it provides a force directed at the top of the rubber sleeve via the first portion 115 of the compression sleeve.

As the sleeve 111 is manufactured of a resilient material, the axial pressure of the spring 118 against the upper surface of the sleeve 111 will provide a radial expansion of the sleeve, whereby this is pressed against the wall 92 and cable 9 and seals against both of these.

When the piston 100 is situated in its upper position, the compression sleeve 114 is in its upper position and exerts no pressure against the sealing sleeve 111. The relief of the piston will involve that this will be pressed downwards by the spring 110. Because of this the spring 118 will press the compression sleeve 114 downwards against the sealing sleeve. Thus, the stuffing box exhibites a fail-safe function, whereby losses of the hydraulic pressure will result in a maximum sealing of the cable.

Preferably, the device comprises different measuring instruments monitoring the work, condition of the stuffing box, pressure and temperature, etc. In particular, it is important to have a leakage detector monitoring whether hydrocabons leak through the sealing sleeve, and a frictional sensor measuring the friction between the cable and sealing sleeve. For example, this may be intended to measure the force on the hydraulic motors. The measurement of the friction involves that the piston may be controlled, whereby the pressure exerted by the spring against the sealing sleeve is controlled. The pressure around the cable may thereby be adjusted. The spring and sleeve are selected from a material enabling achievement of an optimum sealing around the cable in the stuffing box.

Preferably, the stuffing box housing is provided with locking means, for example grooves or ridges, which cooperate with corresponding means in the device to maintain the stuffing box in a fixed position during use.

During the intervention of a well according to a prior art technique, the vessel is positioned to be situated approximately in the extension of the axis of the well 4. Moreover, it will normally be attempted to keep the vessel at this position during the operation, either by means of the anchors or dynamic positioning.

By the method according to the invention the vessel 1 will be located straigthly above the well 4 only in a first stage of the work. In a first stage of the work the lubricator assembly 5 is lowered to the well and connected to the Christmas tree. The lubricator may be lowered as several components but, preferably, it will be made ready on the vessel, and lowered as an assembly. This results in the advantage of enabling the connectors to be pressure tested on the vessel. During this stage the umbilical 7 also is connected to the lubricator.

Now, the stuffing box and tool are made ready on the vessel. The cable 9 is led through the stuffing box and its free end is attached to the tool 8. Then, the drive mechanism 12 is used to lower the stuffing box towards the lubricator, with the tool 8 suspended by the cable 9. In the injector the drive belts have been moved away from one another, whereby the tool and stuffing box may be inserted into the tool housing and the stuffing box locked, for example fastened within the injector housing, as shown in FIG. 5. This and later operations are monitored by the ROV 15.

As described above the injector head is constructed in a manner enabling the components to be moved from one another and permitting the insertion of the stuffing box with the tool suspended by cable, and the locking to the injector housing or tool housing. Locking means, such as pins, snap rings or the like, fasten the stuffing box during the work.

During this part of the operation, the vessel is situated vertically above the well, as mentioned above, and the heave compensator on the vessel is used to secure a safe lowering. This is the situation shown in FIG. 1. During this stage of the operation, there are no risks to the vessel, as the well is closed completely in this stage, i.e. all of the valves in the Christmas tree are closed.

Figure 2:
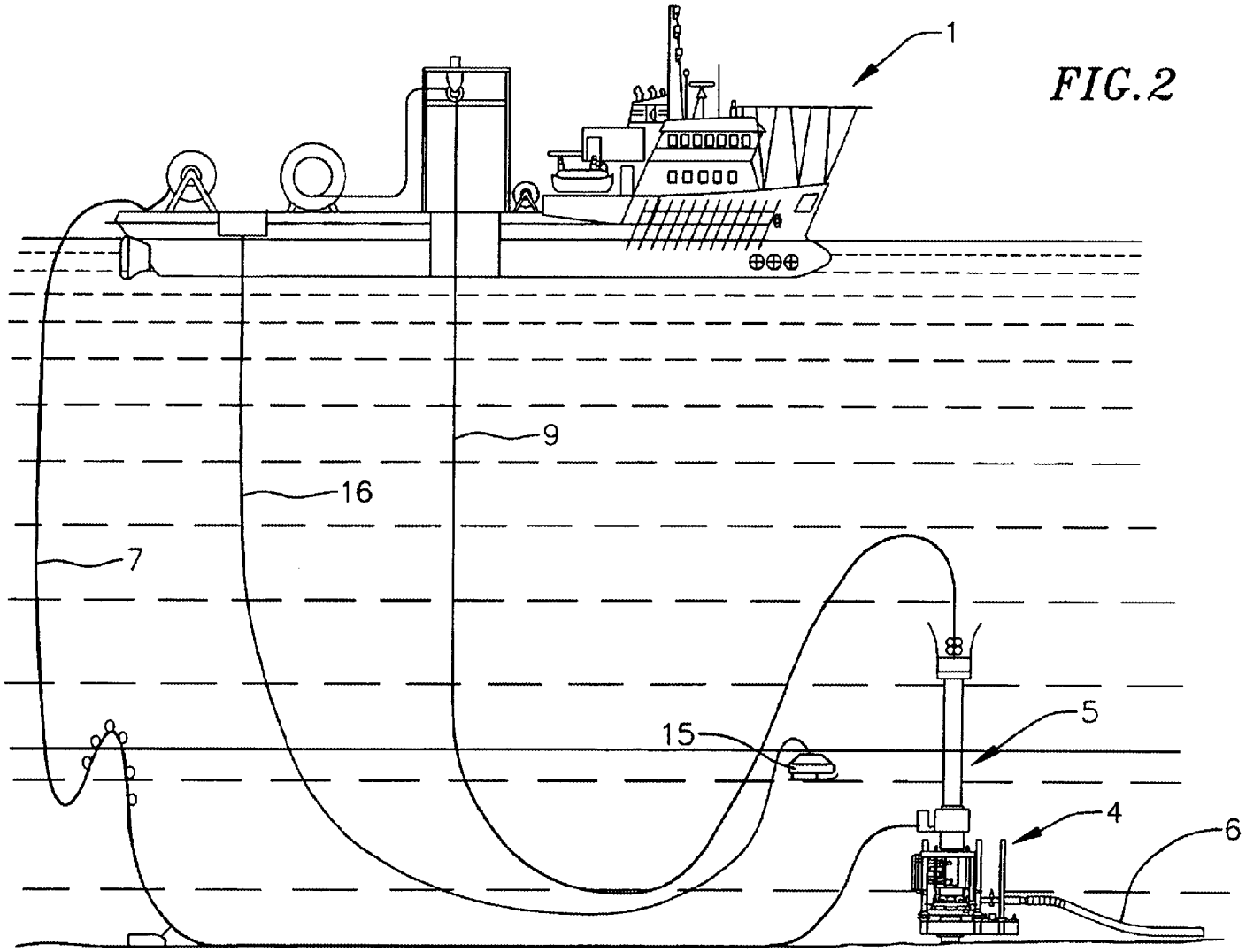
FIG. 2 is an illustration showing a second aspect of intervention according to the invention.

Now, the vessel is moved away from this position, possibly by permitting the vessel to be drifted by the wind, whereby the vessel is moved away from the well while feeding the cable from the injector 12 and the umbilical from the drum 14. The movement is monitored and controlled from the vessel by means of the dynamic positioning. The controlled feeding is effected in such a manner holding the cable 9 (and possibly the umbilical 7) in a desired S-shaped arc where these extend between the vessel and the well (FIG. 2). This continues until the vessel is situated at a certain distance, for example about 200 meters, aside of the well.

Thus, in FIG. 2 is shown the situation during the intervention work itself. The vessel is situated at a distance from the well and the cable is hanging in an S-arc in the sea. The dynamic positioning reads the position of the vessel in relation to the well and signals whether the cable shall be fed or withdrawn, whereby this configuration might be maintained.

Now, the valves in the Christmas tree may be opened. The injector 50 is started to push the tool downwards in the well. Simultaneously, the drive mechanism 12 is started to feed the cable from the vessel. The desired S-curve of the cable is maintained by such a coordination of the two injectors.

When the tool has reached the desired depth in the well, the injector 50 is stopped and the required measurements (or another operation) are performed. If the vessel should have been moved in relation to the well during this stage, the injector may be started to feed, respectively withdraw, the necessary length of the cable to maintain the desired S-curve in the sea.

It shall be noted that when it is desired that the cable extends in an S-curve in the sea, this first of all is due to practical reasons. The arc will provide a slack in the cable, whereby the movements of the vessel may be absorbed without subjecting the cable to strains which may result in rupture. Regardlessly, the dynamic positioning system on the vessel has a response time which has to be taken into consideration.

After the works are completed the injector is restarted to withdraw the cable. Simultaneously, the drive mechanism 12 on the vessel and the drum 14 for the umbilical are started. During this stage the vessel also is aside of the well and the process is monitored, whereby the cable also now maintains the required S-curve. When the tool is situated within the tool housing, both of the injectors are stopped. The injector 12 on the vessel is only started if the vessel moves. Unwanted hydrocarbons may now be circulated out of the lubricator, as discussed in NO Patent No. 309439. Then, the valves of the Christmas tree and the lubricator are closed. Now, the propulsion machinery of the vessel also is started to move the vessel backwards into a position straigthly above the well. Simultaneously, the injector 12 (and the drum 14) are driven to withdraw the cable and the umbilical. When the vessel again is situated straigthly above the well, the situation shown in FIG. 1 is re-established.

After the works are completed in the well, the injector is opened and the stuffing box retrieved together with the tool. Both the cable and the sealing sleeve may thereby be inspected for wear and possible replacement. If another invention type is required in the well, another tool may be attached to the cable, and the operation discussed above may be performed.

Figure 3:
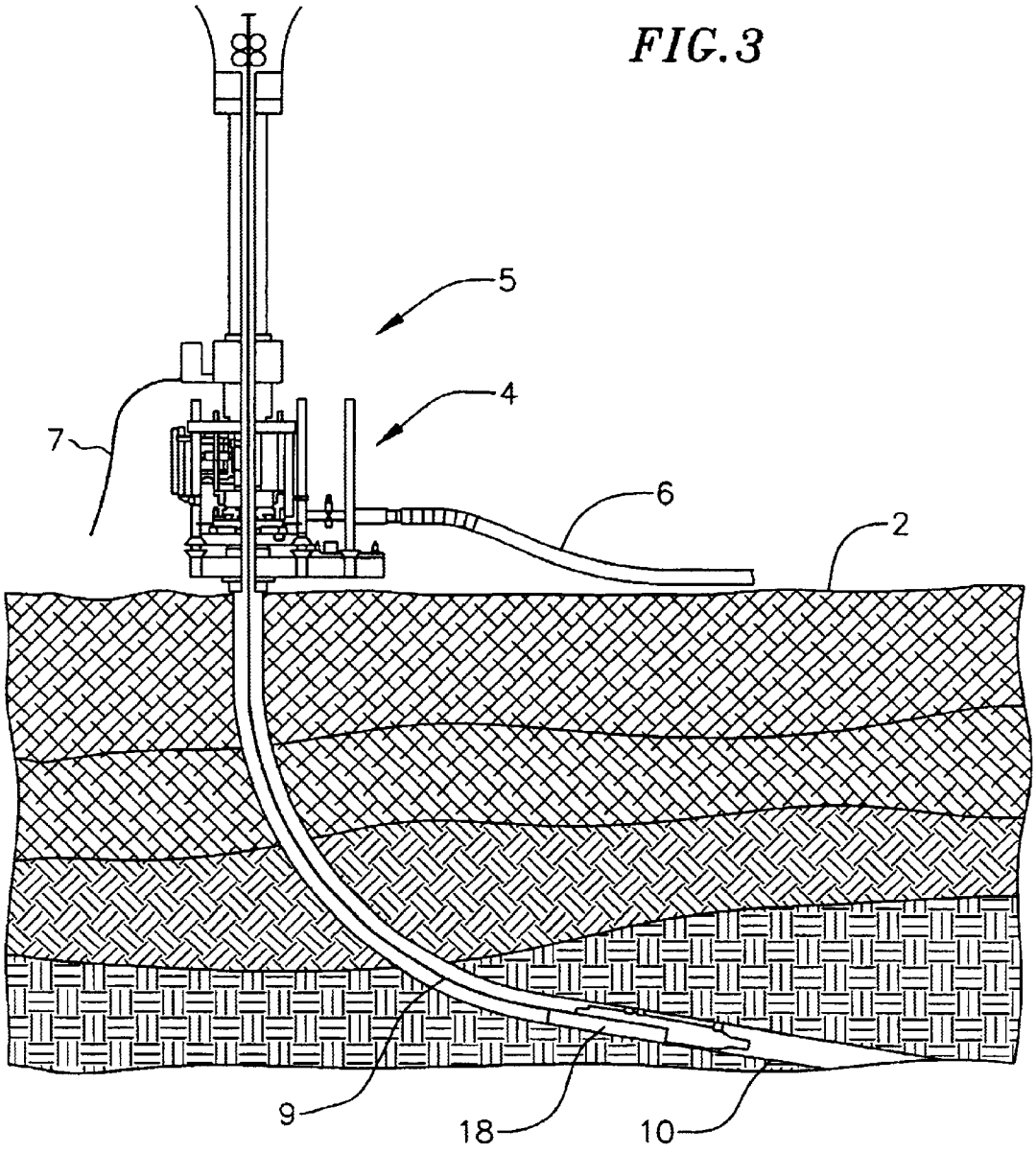
FIG. 3 is an illustration of the invention used with a tractor.

Because the preferred cable has a large elastic modulus (larger rigidity), it may be pushed into sloping and horizontal wells. Because it is desired that the cable might be winded on a drum, it may not be too rigid. It may thereby be pushed longer into horizontal wells than a wire but there is a limit to how far it may be pushed. However, the described method may also be used in such cases. The tool may be connected to a self-movable tractor 18 in stead of, or in addition to the injector 50 on the lubricator, as illustrated in FIG. 3. The movement of the tractor is coordinated with the injector on the vessel, in the same manner as by the use of two injectors. In deviation wells all of the shown feed mechanisms may possibly be used, using for example the injector 50 in the vertical portion while operating the tractor in the horizontal portion of the well.

What is claimed is:

1. A device for performing intervention on a subsea well from a floating vessel, said well having a Christmas tree connected thereto, said device comprising:

a cable suspended from said vessel and extending to said well;

a drive mechanism located at the vessel for selectively feeding and withdrawing said cable in response to movements of the vessel relative to the well;

a lubricator adapted for placement on said Christmas tree, said lubricator comprising:

a tool housing for insertion of a tool into the well, and a sealing assembly for slidably and sealingly enclosing said cable as said cable passes therethrough; and a cable feed mechanism for selectively feeding said cable into the well and alternatively withdrawing said cable from the well, said cable feed mechanism being controlled independently from said drive mechanism.

2. The device according to claim 1, wherein said cable feed mechanism comprises an injector located on said lubricator.

3. The device according to claim 1, wherein said cable feed mechanism comprises a self-movable tractor fastened to said cable and disposed in the well.

4. The device according to claim 2, wherein said injector further comprises:

at least first and second continuous belts disposed generally on opposite sides of said cable;

at least one drive roller for driving at least one of said first and second continuous belts; and at least one hydraulic motor for driving said at least one drive roller.

5. The device according to claim 4, wherein said injector further comprises an actuator for moving said at least first and second continuous belts selectively towards and away from each other.

6. The device according to claim 4, wherein said drive roller and at least one of said at least first and second continuous belts each further comprise complimentary drive teeth.

7. The device according to claim 4, wherein at least one of said first and second continuous belts further comprises a cable receiving groove for receiving said cable.

8. The device according to claim 2, wherein said injector further comprises:

at least first and second continuous belts disposed generally on opposite sides of said cable, at least one of said continuous belts having drive teeth thereon, and at least one of said continuous belts having a cable receiving groove for receiving said cable;

at least one drive roller for driving one of said at least first and second continuous belts, said drive roller having drive teeth for engaging said drive teeth on said continuous belt;

at least one hydraulic motor for driving said drive roller; and actuator means for moving said first and second continuous belts selectively towards and away from each other.

9. The device according to claim 1, wherein the drive mechanism selectively feeds and withdraws the cable in response to horizontal movements of the vessel relative to the well.

10. The device according to claim 1, wherein the drive mechanism selectively feeds and withdraws the cable in response to movements of the vessel relative to the well to add or remove slack in the cable.

11. A device for performing intervention on a subsea well from a floating vessel, said well having a Christmas tree connected thereto, said device comprising:

a cable suspended from said vessel and extending to said well, a drive mechanism located at the vessel for selectively feeding and withdrawing said cable in response to movements of the vessel relative to the well, and a lubricator adapted for placement on said Christmas tree, said lubricator comprising:

a tool housing for insertion of a tool into the well, and a sealing assembly for slidably and sealingly enclosing said cable as said cable passes therethrough, and a cable feed mechanism for selectively feeding said cable into the well and alternatively withdrawing said cable from the well, said cable feed mechanism being controlled independently from said drive mechanism; and wherein said sealing assembly comprises an elastic sleeve element surrounding said cable, said elastic sleeve element expanding radially when subjected to an axial load, such that said elastic sleeve element seals against said cable.

12. The device according to claim 11, wherein said sealing assembly further comprises a compression sleeve disposed proximate to said elastic sleeve element, and a compression spring disposed between said compression sleeve and a nut member, said compression spring exerting a first axial load on said compression sleeve such that said first axial load is transmitted through said compression sleeve to said elastic sleeve element.

13. The device according to claim 12, wherein said sealing assembly further comprises a fluid piston assembly connected to said nut member for moving said nut member axially relative to said compression sleeve to change the compressed length of said compression spring such that said first axial load can be selectively increased or decreased.

14. A device for performing intervention on a subsea well from a floating vessel, said well having a Christmas tree connected thereto, said device comprising:

a cable suspended from said vessel and extending to said well, a drive mechanism located at the vessel for selectively feeding and withdrawing said cable in response to movements of the vessel relative to the well, and a lubricator adapted for placement on said Christmas tree, said lubricator comprising:

a tool housing for insertion of a tool into the well, and a sealing assembly for slidably and sealingly enclosing said cable as said cable passes therethrough, and a cable feed mechanism for selectively feeding said cable into the well and alternatively withdrawing said cable from the well, said cable feed mechanism being controlled independently from said drive mechanism; and wherein said cable is a composite cable comprising:

an elastomeric matrix;

a plurality of fibers for reinforcing said elastomeric matrix, said fibers having a higher tensile strength than said elastomeric matrix; and an outer coating having a lower coefficient of friction than said elastomeric matrix.

15. The device according to claim 14, wherein said fibers comprise a material selected from the group consisting of grass and carbon.

16. The device according to claim 14, wherein the bulk elastic modulus of said cable ranges from about 40,000 to about 130,000 MPa.

17. The device according to claim 14, wherein the coefficient of friction of said outer coating is less than about 0.2.

18. The device according to claim 14, wherein said cable further comprises at least one electrical conductor.

19. The device according to claim 18, wherein said electrical conductor is enclosed in an insulating jacket.

20. The device according to claim 15, wherein said cable further comprises at least one electrical conductor.

21. A method for performing intervention on a subsea well from a floating vessel, said well having a Christmas tree connected thereto, said method comprising:

suspending a cable from the vessel;

extending said cable to the well;

providing a drive mechanism at the vessel for selectively feeding and withdrawing said cable in response to movements of the vessel relative to the well;

providing a cable feed mechanism at the well for selectively feeding said cable into the well and alternatively withdrawing said cable from the well; and controlling said cable feed mechanism independently from said drive mechanism.

22. The method according to claim 21, wherein said drive mechanism and said cable feed mechanism are controlled such that they feed said cable at approximately the same rate when the vessel is not moving relative to the well.

23. The method according to claim 21, wherein said drive mechanism and said cable feed mechanism are controlled such that they feed said cable at generally different rates when the vessel is moving relative to the well.

24. The method according to claim 23, wherein said drive mechanism and said cable feed mechanism are controlled such that said drive mechanism feeds said cable faster than said cable feed mechanism when the vessel is moving away from the well.

25. The method according to claim 23, wherein said drive mechanism and said cable feed mechanism are controlled such that said drive mechanism feeds said cable more slowly than said cable feed mechanism when the vessel is moving towards the well.

26. The method according to claim 21, wherein the drive mechanism selectively feeds and withdraws the cable in response to horizontal movements of the vessel relative to the well.

27. The method according to claim 21, wherein the drive mechanism selectively feeds and withdraws the cable in response to movements of the vessel relative to the well to add or remove slack in the cable.

28. A method for performing intervention on a subsea well from a floating vessel, said well having a Christmas tree connected thereto, said method comprising:

suspending a cable from the vessel;

extending said cable to the well;

providing a drive mechanism at the vessel for selectively feeding and withdrawing said cable in response to movements of the vessel relative to the well;

providing a cable feed mechanism at the well for selectively feeding said cable into the well and alternatively withdrawing said cable from the well; and controlling said cable feed mechanism independently from said drive mechanism;

wherein said drive mechanism and said cable feed mechanism are controlled such that said cable adopts a generally S-shaped curve in the sea.

* * * * *